United States Patent [19]

Miyazaki et al.

[11] 4,195,788

[45] Apr. 1, 1980

[54] APPARATUS FOR FORMING TRANSFER TAIL WINDINGS ON A BOBBIN IN AN OPEN-END SPINNING MACHINE

[75] Inventors: Tsutomu Miyazaki; Takeshi Shimizu; Keiji Onoue, all of Kariya, Japan

[73] Assignee: Kabushiki Kaisha Toyoda Jidoshokki Seisakusho, Kariya, Japan

[21] Appl. No.: 22,005

[22] Filed: Mar. 19, 1979

[30] Foreign Application Priority Data

Mar. 20, 1978 [JP] Japan ..... 53-32765

[51] Int. Cl.[2] ..... B65H 54/02; B65H 54/34; B65H 65/00

[52] U.S. Cl. ..... 242/18 PW; 242/125.1; 242/165

[58] Field of Search ..... 242/18 PW, 125.1, 165; 57/299

[56] References Cited

U.S. PATENT DOCUMENTS

| | | | |
|---|---|---|---|
| 3,858,816 | 1/1975 | Corbiere | 242/18 PW |
| 3,955,775 | 5/1976 | Egyptien et al. | 242/18 PW X |
| 4,022,389 | 5/1977 | Slavik et al. | 242/18 PW |
| 4,050,645 | 9/1977 | Burchette, Jr. et al. | 242/18 PW X |
| 4,057,196 | 11/1977 | Amos | 242/18 PW |
| 4,093,135 | 6/1978 | Hermanns | 242/18 PW |
| 4,102,507 | 7/1978 | Hoffmann et al. | 242/18 PW |
| 4,105,165 | 8/1978 | Miyazaki et al. | 242/18 PW |
| 4,158,444 | 6/1979 | Krauss | 242/18 PW |

FOREIGN PATENT DOCUMENTS

| | | | |
|---|---|---|---|
| 2657798 | 6/1978 | Fed. Rep. of Germany | 242/18 PW |
| 1435235 | 5/1976 | United Kingdom | 242/18 PW |

*Primary Examiner*—Stanley N. Gilreath
*Attorney, Agent, or Firm*—Sughrue, Rothwell, Mion, Zinn and Macpeak

[57] ABSTRACT

An apparatus for forming transfer tail windings on a bobbin includes a bobbin having an annular groove adjacent one end thereof which in the case of a tapered bobbin, would be located adjacent the larger diameter end. The annular groove is provided with a radially disposed wall and an inclined wall which is tapered outwardly from the radial wall toward the end of the bobbin. A spring-biased pivoted yarn regulator extends transversely across the path of the yarn from the spinning unit to the deepest portion of the annular groove on the bobbin and is provided with a yarn guide portion opposite the inclined surface of the annular groove. A centering disc engages the end of the bobbin adjacent the annular groove and is provided with a plurality of yarn engaging notches spaced about the circumference thereof. The yarn from the spinning unit is directed over the yarn guide portion of the yarn regulator around the bottom of the annular groove and over the top of the annular groove back toward the yarn regulator. Upon initiating rotation of the bobbin, the free end of the yarn will be shifted laterally into engagement with a notch on the centering disc to wrap the free end of the yarn diagonally about the inclined surface so that subsequent windings will overlie the free end of the yarn. After a predetermined number of turns, the yarn regulator will be pivoted against the bias of the spring to release the yarn from the yarn guide portion whereupon the winding of the yarn upon the main portion of the bobbin will commence.

5 Claims, 8 Drawing Figures

APPARATUS FOR FORMING TRANSFER TAIL WINDINGS ON A BOBBIN IN AN OPEN-END SPINNING MACHINE

BACKGROUND OF THE INVENTION

1. Field of the Invention

The present invention relates to an apparatus for forming transfer tail windings on a bobbin which is utilized in combination with an open-end spinning machine.

2. Prior Art

In open-end spinning machines, in general, the yarn which is drawn out from the spinning unit is woundup in the form of a cheese on a cylindrical bobbin or a tapered bobbin which is mounted for rotation about an axis substantially parallel to the axis of the takeup roller of the spinning unit. In addition to the regular yarn windings on the bobbin, a number of yarn windings referred to as transfer tail windings are usually formed on the same bobbin outside one end of the regular yarn windings for the purpose of improving the working efficiency in subsequent yarn handling processes such as knitting, weaving or the like. In knitting machines or weaving machines, it is required that the yarn to be supplied thereto should be continuous without any gap so that it will not be necessary to interrupt the machine operation. Therefore, cheeses of yarn having such transfer tail windings are used so that the trailing end of the yarn cheese still loaded on the knitting or weaving machine may be successively joined with the leading yarn end of a yarn cheese to be loaded next, thus making it possible to replace the former cheese with the latter with ease and without any loss of time.

Various methods and means for forming such transfer tail windings on a bobbin have been contemplated and conventional methods all share a crucial disadvantage in common in that the formation cannot be accomplished in a reliable manner. For example, the nipping of the yarn end of the transfer tail windings by a regular yarn winding is improper so that the transfer tail windings end on the bobbin tends to become loose during cheese forming operation thereby resulting in the loss of the entire tail windings on the bobbin. Also, as a result of such improper nipping of the yarn end, all of the transfer tails windings on the bobbin tend to move transversely while a cheese is being formed and either move under the regular windings or slip off the end of the bobbin.

SUMMARY OF THE INVENTION

The present invention provides a new and improved apparatus for forming transfer tail windings which overcomes all of the drawbacks of the aforementioned methods and apparatus.

The present invention provides an apparatus for forming transfer tail windings including a new and improved bobbin having an annular tapered groove adjacent one end thereof and a new and improved yarn regulator and guide disposed adjacent thereto which function to securely locate and anchor the transfer tail windings in the tapered groove prior to the formation of the yarn cheese on the remainder of the bobbin.

The foregoing and other objects, features and advantages of the invention will be apparent from the following more particular description of a preferred embodiment of the invention as illustrated in the accompanying drawings.

DETAILED DESCRIPTION OF A PREFERRED EMBODIMENT

Figure 1:
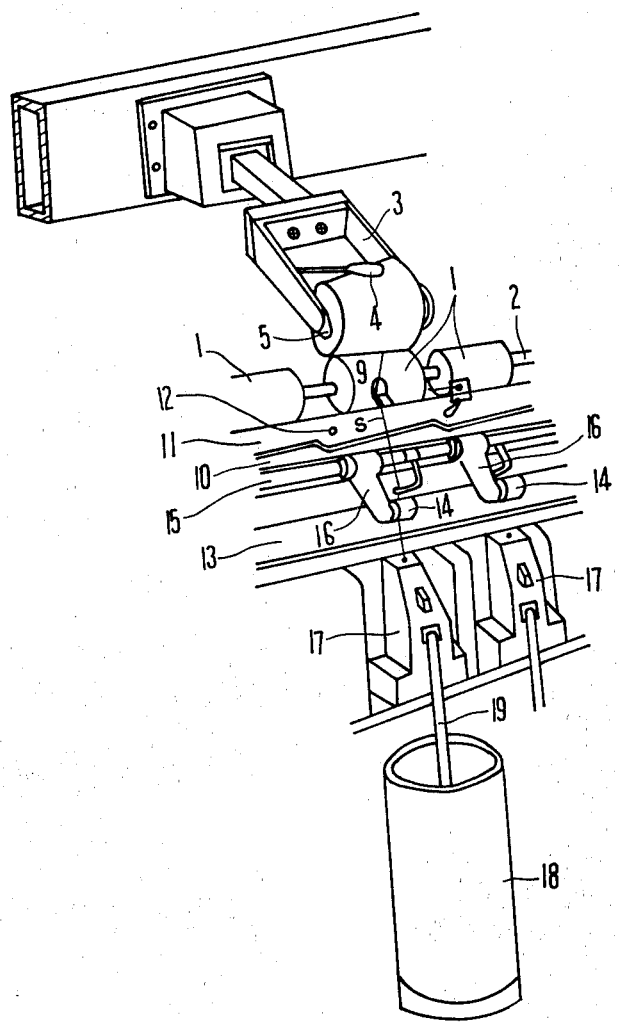
FIG. 1 is a schematic fragmentary perspective view of an open-end spinning machine having an apparatus for forming transfer tail windings on a bobbin according to the present invention.

In the open-end spinning machine shown in FIG. 1, only a single complete spinning, guiding and winding arrangement is shown but it is to be understood that a plurality of such arrangements are disposed adjacent to each other in such a spinning machine. Therefore, in describing the preferred embodiment according to the present invention, reference will only be made to a single arrangement.

A takeup drum 1 is mounted on a rotatable shaft 2 and the shaft is positively driven to rotate the drum in the direction as designated by the arrowhead P. A cradle arm comprised of a bobbin holder 3 and a handle 4 is disposed above the drum 1 and a tapered bobbin 5 is detachably and rotatably supported in the bobbin holder 3 by means of the centering disc 6. A plurality of notches 7 are formed on the inner circumferential edge of the disc 6 and the centering disc 6 is disposed adjacent the end of the bobbin on which the transfer tail windings are to be formed. In the case of a tapered bobbin, the centering disc 6 will be disposed adjacent the larger diameter end of the bobbin. The notches 7 are adapted to hook the free end of the yarn during the initial winding of the transfer tail windings. As the takeup drum 1 starts to rotate in the direction as indicated by arrowhead P, the bobbin 5 which is urged to press against the rotating takeup drum, will be rotated in the opposite direction Q.

A shaft 8 is located in front of and below the takeup drum 1 and carries traverse guide 9 which is fixedly mounted thereon. The shaft 8 is reciprocated transversely by the action of a transverse cam (not shown) so that the traverse guide 9 secured to the shaft 8 functions to swing the yarn S traversely and alternately in accordance with the reciprocating motion of the shaft 8.

An air sucker 10 is provided in common for all of the spinning units and is disposed longitudinally on the front side of the machine at a slightly lower level relative to the shaft 8 carrying the traverse guide 9. The air sucker 10 is equipped with a yarn guide plate 11 through which a suction hole 12 is formed in substantial alignment with the larger diameter end of the tapered bobbin 5 to permit holding the free end of the yarn during a doffing operation. A top roller 14 which is supported on the rod 15 by means of a holder 16 is disposed in contact with a takeup roller 13. According to this arrangement, the silver 19 is delivered from the can 18 to the spinning unit 17 and a spun yarn S is fed from the spinning unit upwardly between the takeup roller 13 and top roller 14 through the bobbin 5 for winding thereon.

Figure 3:
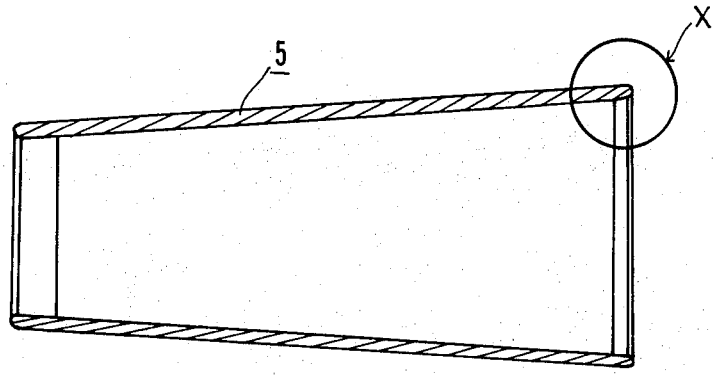
FIG. 3 is a longitudinal sectional view of an improved bobbin according to the present invention.
Figure 4:
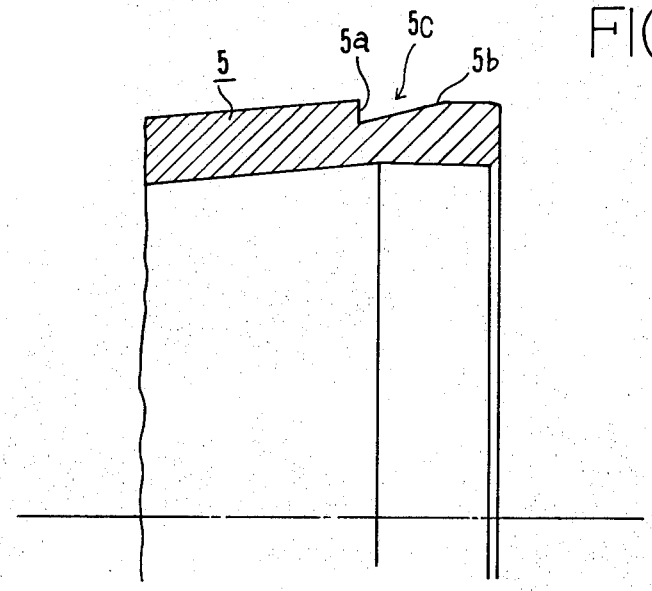
FIG. 4 is an enlarged fragmentary sectional view detailing the circled portion X as shown in FIG. 3.

According to the present invention, a bobbin 5 is provided with a specific location for the transfer tail windings as best shown in FIGS. 3 and 4. The bobbin 5 is provided adjacent its larger diameter end with an annular groove 5c in the circumference thereof to prevent the yarn for the transfer tail windings from moving into the surface area on the bobbin reserved for regular yarn windings. The annular groove 5c is comprised of a radially disposed control portion 5a to prevent the yarn from moving onto the surface for regular yarn windings and an inclined portion 5b which tapers outwardly from the radially innermost end of the control portion toward the larger diameter end of the bobbin.

Figure 2:
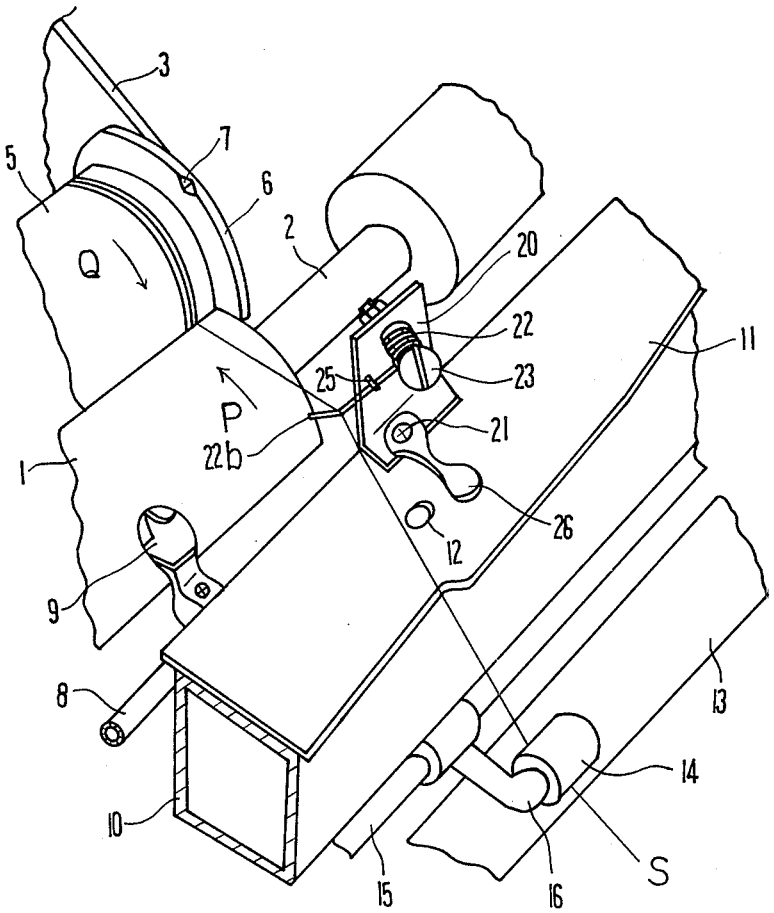
FIG. 2 is an enlarged view showing a portion of the machine shown in FIG. 1 illustrating the winding arrangement in greater detail.
Figure 5:
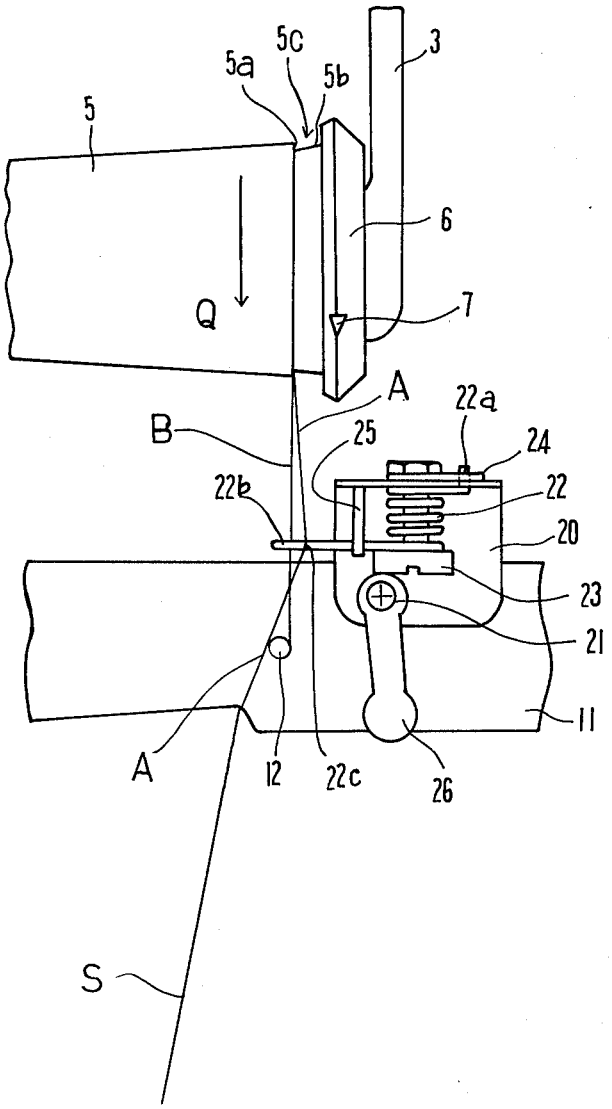
FIG. 5 is a schematic plan view showing the relative locations in horizontal relationship between the bobbin and yarn regulating and guiding apparatus during formation of transfer tail windings.
Figure 6:
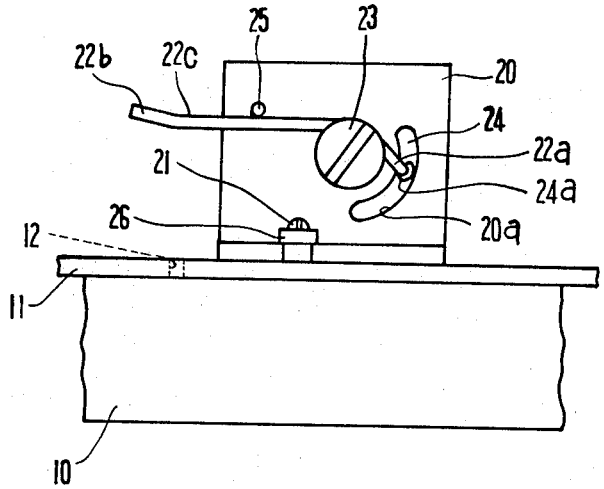
FIG. 6 is a front elevation view showing the relative locations in vertical relationship between the bobbin and the yarn regulating and guide member during the formation of transfer tail windings.
Figure 7:
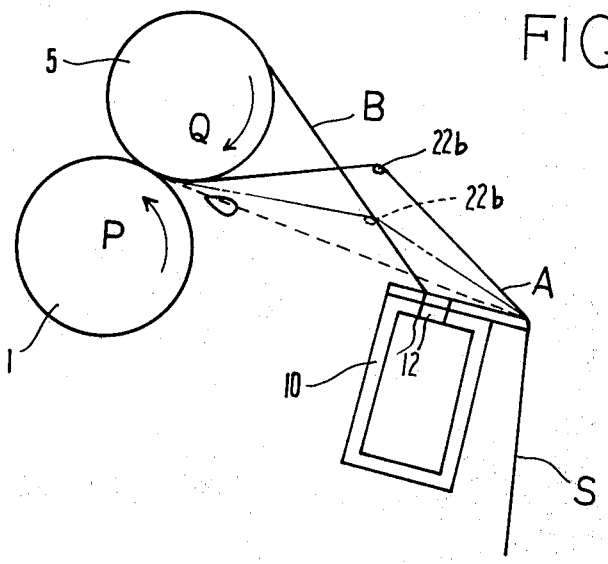
FIG. 7 is a schematic end view showing the yarn relative to the bobbin and yarn regulator and guide means during the initiation of the formation of transfer tail windings.

The yarn regulating and guide member according to the present invention which is used to assist in the formation of the transfer tail windings is best shown in FIGS. 2, 5 and 6 and is comprised of a mounting bracket 20 having an L-shaped cross-section secured onto the yarn guide plate 11 by means of a screw 21 at a suitable location which corresponds to the transfer tail winding end of the bobbin 5. A nut and bolt arrangement 23 is disposed through the perpendicular portion of the bracket 20 and adjustably clamps a plate 24 to the bracket 20 for rotation about the shank of the bolt on one side of the bracket. A coil spring 22 is wrapped about the shank of the bolt on the opposite side of the perpendicular portion of the bracket 20 and one end 22a of the coil spring 22 extends through an arcuate slot 20a in the bracket 20 and is engaged in a hole 24a in the plate 24. The other end portion of the spring 22 extends substantially horizontally and the end 22b thereof is bent slightly upwardly to form a yarn regulating portion and a yarn guide at the bend 22c. The yarn regulating and guide member is located on the yarn guide plate so that the guide portion 22c corresponds to the portion of the bobbin for transfer tail windings. More specifically, the yarn guide portion 22c should be substantially aligned with the inclined portion 5b on the bobbin 5 as shown in FIG. 5. The height of the yarn guide portion 22c should be above the lowermost surface of the bobbin 5 as shown in FIG. 7. A stop pin 25 protrudes from the perpendicular portion of the bracket 20 to limit the upward movement of the yarn regulating portion 22b. The resilience of the coil spring 22 may be altered as desired by changing the position of the hole 24a which can be accomplished by turning the plate 24 about the shank of the bolt 23. A cover member 26 is provided for the suction hole 12 and is pivoted on the horizontal portion of the bracket 20 by means of a screw 21.

In the operation of the apparatus for forming transfer tail windings, the yarn S being wound onto a bobbin 5 which is substantially filled is cut at an appropriate position and the free end of the yarn leading from the spinning unit 17 is held with the free end inserted into the suction hole 12 of the air sucker 10. Upon raising the bobbin holder 3 upwardly the full package on the cradle arm is removed from the holder and a new empty bobbin 5 is installed in the holder 3. After the cradle arm has been loaded with an empty bobbin, the free end of the yarn is removed from the air sucker 10 and directed beneath, around and over the bobbin 5 in the groove 5c back to the air sucker 10. The portion of the yarn as designated A which is located before the partial turn over the bobbin's periphery is then hooked over the end of the spring 22 and is disposed in the yarn guide portion 22c. The bobbin holder 3 is then lowered to bring the bobbin 5 into contact with the takeup drum 1 to initiate the rotation of the bobbin 5 in the direction Q together with the centering disc 6.

Figure 8:
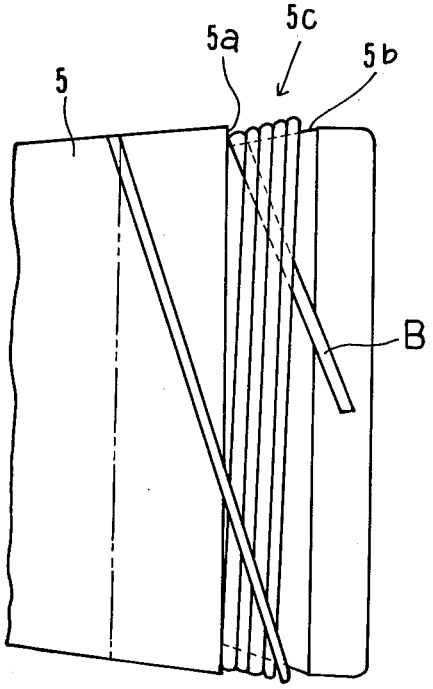
FIG. 8 is a fragmentary front elevation view of a bobbin showing the details of the transfer tail windings formed according to the present invention.

As the bobbin 5 begins to rotate, the portion of the yarn S designated B is moved either by hand or by means of a yarn moving device (not shown) toward the centering disc 6. By so doing, the portion B is engaged by one of the notches 7 provided on the centering disc 6 as the yarn is brought into contact with the marginal circumferential edge of the disc 6 which is rotating in the direction Q. The portion B is then forced in the direction of rotation of the bobbin 5 with the air sucker 10 exerting a force to pull the yarn end back in the opposite direction. As soon as the yarn S is cutoff due to increased tension upon rotation of the bobbin 5, the yarn S in the portion A is then wound on the inclined surface 5b of the annular groove 5c. The yarn portion B will be disposed diagonally over the inclined surface 5b as best shown in FIG. 8 and the transfer tail windings are laid adjacent each other over the portion B. The radially disposed wall portion 5a of the groove prevents the transfer tail windings from moving onto the main surface of the bobbin and the inclined surface 5b will cause adjacent turns to be disposed in engagement with each other in ever increasing diameters. Thus, the portion B will be securely nipped by the new yarn which is drawn out from the spinning unit and the turns of newly supplied yarn will form transfer tail windings which are securely located against any transverse shifting movement.

Because the transfer tail winding is performed on the larger end of the bobbin 5, the yarn S will be subjected to a gradually increasing tension as the yarn winding-up requirement becomes greater than the spinning speed of the spinning unit 17. This increase in tension will be exerted on the yarn regulator spring 22 over which the yarn S is engaged at the guide portion 22c to cause the yarn regulator portion 22b to move downwardly in opposition to the resilience of the spring 22 as shown in FIG. 7. This yielding of the yarn regulator spring 22 will decrease the force exerted on the yarn S so that the yarn S will not be broken by the increase in tension. When the yarn regulating portion 22b is lowered below a predetermined angle, the yarn S will slip off the end of the yarn regulating portion 22b and subsequent windings of the yarn will take place on the main surface of the bobbin 5. If the rate of increase at which the tension is applied to the yarn S is constant, the length of the transfer tail windings on the bobbin 5 thus formed will also be constant. The transfer tail winding length can be determined by controlling the speed at which the yarn regulator spring 22 is turned or inclined. In other words, if the speed is arranged to be relatively high, the yarn S will slip off the yarn regulator portion 22b at an earlier time thereby resulting in a shorter transfer tail winding length. On the other hand, at a lower speed, the windings will become longer in length. Thanks to such an arrangement, the transfer tail winding length can be controlled as desired by turning the plate 24 to change the force of the coil spring 22. Preferably, this provision should be made so that the resilience of the coil spring 22 can be changed freely as required because the tension applicable to the yarn S varies with the count number of the yarn to be wound and other various conditions in winding. When a predetermined number or amount of transfer tail windings have been formed on the bobbin 5, the yarn S will then be wound up onto the bobbin 5 transversely with the aid of traverse guide 9.

While the invention has been particularly shown and described with reference to a preferred embodiment thereof, it will be understood by those in the art that various changes in form and detail may be made therein without departing from the spirit and scope of the invention.

What is claimed is:

1. An apparatus for forming transfer tail windings on a bobbin in an open-end spinning machine comprising a bobbin having an annular groove disposed in the circumference thereof adjacent one end, said groove having a radially disposed wall portion to prevent transfer tail windings formed in said groove from moving toward the other end of said bobbin and an inclined portion which tapers outwardly from the radially inward portion of said wall toward said end of said bobbin, and yarn regulator and guide means mounted on said machine adjacent said groove for guiding the yarn onto said inclined surface upon rotation of said bobbin to form transfer tail windings.

2. An apparatus as set forth in claim 1, wherein said yarn regulator and guide means is comprised of an adjustable spring means extending transversely across the path of the yarn being fed to said groove for guiding the yarn and regulating the tension applied to said yarn as the diameter of the windings increase on the inclined portion of said groove.

3. An apparatus as set forth in claim 2, wherein said spring means is comprised of a coil spring having one end adjustably anchored to said machine and the other end thereof extending across the path of the yarn leading to said groove, the free end of said spring being bent upwardly to define a guide portion for the yarn to maintain the yarn in engagement with the spring to form transfer tail windings in said groove until the end of said spring is biased to a position allowing the yarn to slip off said spring.

4. An apparatus as set forth in claim 2, further comprising a centering disc disposed in engagement with the end of said bobbin having a groove adjacent thereto, at least one yarn engaging notch disposed about the periphery of said disc whereby upon engagement with the free end of the yarn entrained about the deepest portion of said groove, the free end will be diagonally wrapped about the inclined surface from the deepest portion thereof toward the end of said bobbin so that subsequent transfer tail windings will be disposed on said diagonally wrapped free yarn end to securely anchor the same.

5. An apparatus as set forth in claim 1, further comprising an air sucker to hold a yarn end by suction which is secured to a machine frame, a suction hole formed in said sucker in substantial alignment with the radially disposed wall portion of said groove.

* * * * *